US006152182A

United States Patent [19]

Grether et al.

[11] Patent Number: 6,152,182

[45] Date of Patent: Nov. 28, 2000

[54] FLOW REGULATOR

[75] Inventors: Hermann Grether, Müllheim; Christoph Weis, Lörrach, both of Germany

[73] Assignee: Dieter Wildfang GmbH, Müllheim, Germany

[21] Appl. No.: 09/291,155

[22] Filed: Apr. 12, 1999

Related U.S. Application Data

[63] Continuation of application No. PCT/EP97/05594, Oct. 10, 1997.

[30] Foreign Application Priority Data

Oct. 11, 1996 [DE] Germany ..... 196 42 055
Mar. 11, 1997 [DE] Germany ..... 297 04 286 U

[51] Int. Cl.[7] ..... F15D 55/00

[52] U.S. Cl. ..... 138/42; 138/37; 138/41

[58] Field of Search ..... 138/37, 40, 41, 138/42

[56] References Cited

U.S. PATENT DOCUMENTS

| | | | |
|---|---|---|---|
| 2,754,097 | 7/1956 | Hjulian | 239/428.5 |
| 4,907,725 | 3/1990 | Durham | 138/42 X |
| 4,921,014 | 5/1990 | Tartaglia et al. | 138/42 X |
| 5,309,946 | 5/1994 | Ligneul | 138/42 X |
| 5,327,941 | 7/1994 | Bitsakis et al. | 138/42 |

FOREIGN PATENT DOCUMENTS

| | | |
|---|---|---|
| 0 646 680 B1 | 9/1994 | European Pat. Off. . |
| 821 777 C | 7/1949 | Germany . |
| 1 890 989 | 12/1963 | Germany . |
| 16 58 232 A1 | 3/1967 | Germany . |
| 30 00 799 C2 | 1/1980 | Germany . |
| 88 14 456 | 11/1998 | Germany . |
| 399 002 | 10/1933 | United Kingdom . |

OTHER PUBLICATIONS

International Search Report dated Feb. 18, 1998 from corresponding priority PCT Application No. PCT/EP97/05594.
Office Action dated Apr. 22, 1997 from related German Application No. 196 42 055.5–25.
Office Action dated Jan. 7, 1998 from related German Application No. 196 42 055.5–25.
Preliminary Examination Report dated May 29, 1998 from corresponding priority PCT Application No. PCT/EP97/05594.

*Primary Examiner*—Patrick Brinson
*Attorney, Agent, or Firm*—Akin, Gump, Strauss, Hauer & Feld, L.L.P.

[57] ABSTRACT

A flow regulator (1) is provided having a flow dispersion device (5) after which in the flow direction (Pfi) a flow regulation device (8) is connected. This flow regulation device (8) has several deflectors arranged in the flow path crosswise to the flow direction (Pf1). For the flow regulator (1) according to the invention it is characteristic, that the deflectors (9) are constructed in a pin or ring shape and set apart at a distance from each other, are connected with at least one mounting part (3, 4) as a single piece, that the at least one mounting part (3, 4) is constructed as an injection molded plastic part with its molded-on deflectors (9) as a single piece, and that the at least one mounting part (3, 4) can be inserted into a flow regulator housing or is constructed as a flow regulator housing (2). The flow regulator (1) according to the invention can be manufactured in a cost-effective manner at a small manufacturing expense, such that it also ensures a noise development in accordance with the standard, even at high liter outputs, and is not susceptible to a calcification of its flow regulation device (8).

34 Claims, 7 Drawing Sheets

FLOW REGULATOR

This application is a continuation of Ser. No. PCT/EP97/05594 filed Oct. 10, 1997.

BACKGROUND OF THE INVENTION

The invention relates to a flow regulator with a sleeve-shaped housing in which a flow regulation device is arranged that has deflectors oriented crosswise to the flow direction.

From German Patent DE-PS 30 00 799, a flow regulator of this general type is already known, which has a flow regulation device with a perforated plate and has a number of flow-through holes for the generation of separate streams. Connected after the perforated plate of this previously known flow regulator in the flow-through direction are an air suction device and a flow regulation device that has several flow regulator sieves. These flow regulator sieves each form a deflector arranged in the flow path crosswise to the flow direction.

The use of a larger number of flow regulator sieves is, however, costly. Also, the requirement is made of such flow regulators that calcification, especially on the flow regulator sieves which are most susceptible to it, be kept small. In the flow regulator previously known from German Patent DE-PS 30 00 799, the perforated plate is constructed in such a manner that it encourages a good flow distribution and the flow regulation sieve can be designed in an accordingly wide-meshed manner. For wide-meshed flow regulator sieves, the danger of blockage and calcification of these sieves through the water flowing through is thus comparably small.

In previously known flow regulators, the regulator sieves are mostly made out of metal, whereas the flow dispersion device is also constructed as a multiple component plastic part. In order to be able to insert the regulator sieves into the previously known flow regulators, the perforated plate functioning as a flow dispersion device could only be detachably mounted on the flow regulator housing, such that prior to the insertion of the perforated plate, the flow regulator sieves can be inserted into the inside of the housing and can be set on an inside ring flange arranged after one of the perforated plates in the flow direction. The multiple component embodiment of the previously known flow regulator and its manufacture from different materials comprises a cost that is not insignificant. Furthermore, the previously known flow regulator consisting of different materials can not be easily removed.

From European Patent EP 94 114 419, a flow regulator is also known in which the perforated plate is located after several cascades that surround each other in a ring shape, which on their side that faces the perforated plate, have pins oriented as flow obstructions opposing the flow direction. This previously known cascade flow regulator is, of course, also constructed as a multiple component, however, can be solely manufactured out of plastic material. Since this previously known flow regulator can thus no longer have any regulator sieves, calcification of this flow regulator can be effectively counteracted. The complicated expense of this flow regulator is disadvantageous, however, and the fact that a standard noise level can not always be ensured at large liter outputs are disadvantageous.

From U.S. Pat. No. 2,754,097, a flow regulator is already known that has individual parts arranged in the outlet nozzle of a sanitary outlet fitting. The previously known flow regulator has a flow dispersion device that has a inflow-side perforated plate with a few flow-through holes as well as a diffuser connected downstream in the flow direction. The diffuser, which functions for the air enrichment of the separate flows generated in the flow dispersion device, has a sleeve-shaped circumferential case, on the outlet-side front end of which, several pin-shaped deflectors project radially inwardly into the flow path. The flow dispersion device that consists essentially of the perforated plate and the diffuser is connected after a flow regulation device, which is manufactured from a star-shaped flat piece that is bent and inserted into the nozzle on the outlet side. The manufacture of this previously known flow regulator is, however, associated with a high cost through the individual components that are bent many times and manufactured from a correspondingly expensive material.

SUMMARY OF THE INVENTION

Thus, the object of the invention is in particular to create a flow regulator of the above-referenced type, that also generates only a standard noise level at high liter outputs and that has a flow regulation device that does not have a tendency to calcify, and can be manufactured in the most cost effective manner from injection molded parts.

In order to achieve this object according to the invention, a proposal according to the invention provides that the sleeve-shaped housing is divided in the longitudinal direction of the flow regulator and is comprised of at least two sleeve parts formed as circumferential segments, which are constructed as plastic injection molded parts and that the deflectors are constructed as deflector-pins and have free pin ends which project from the inside of at least one circumferential segment, and are connected as a single piece with this circumferential segment.

Another proposal according to the invention provides a mounting part that is constructed as a band-shaped flat part prior to being inserted into the flow regulator housing, onto which the deflectors that project radially and are constructed as deflector-pins and are molded as a single piece.

Finally, an additional solution according to the invention consists in that a central mounting part arranged approximately coaxially to the longitudinal axis of the flow regulator is provided and that the mounting part is connected to the deflectors.

In the flow regulation device of the flow regulator according to the invention, pin or ring shaped deflectors are planned which are provided in at least one sleeve part that is constructed as a circumferential segment of the flow regulator housing or are provided on a mounting part. The sleeve part or mounting part is constructed as a single piece with the molded-on deflectors. This flow regulation device makes traditional flow regulator sieves at least in a larger number unnecessary, so that the manufacturing expense can be reduced considerably. Since the deflectors can be molded onto the sleeve part or mounting part in a flow regulator housing, or constructed itself as a flow regulator housing, the reduced manufacturing expense is also favorable. Such plastic injection molded parts, which have deflectors constructed in a pin or ring shape molded onto at least one sleeve part or mounting part, can be manufactured in an especially simple and cost-effective manner, since a subsequent mounting of metal flow regulator sieves can be omitted. In a flow dispersion device that is customarily also made of plastic, the entire flow regulator can be manufactured from only one material and removed in a correspondingly simple manner or even furnished for reuse of the plastic material. In this way, the flow regulation device, which consists of the deflectors that are oriented crosswise to the flow direction and constructed in a pin or ring shape, has less of a tendency to calcify, than occurs in traditional flow regulator sieves, especially at the intersection points of the grid structure of the individual sieves. Using the deflectors that are oriented crosswise to the flow direction and set apart at a distance from each other in the flow direction and/or in the circumferential direction, a sufficient flow regulation can be achieved even at high liter outputs, in order to ensure that only a standard noise level is developed.

Particularly for a flow regulator with air suction, an especially good and effective flow regulation can be achieved, when deflectors arranged parallel to each other are arranged preferably in a grid shape in at least one plane oriented crosswise to the flow-through direction and if, in particular, several pin layers are arranged in planes set apart at a distance from each other in the flow-through direction. While in this manner, the pin layers on the flow-through side stall the separate streams generated by the flow dispersion device, the deflector pins can be set apart a distance from each other in a downstream side pin layer in such a manner that a function-impairing calcification is prevented and a water layer that encloses the flow regulator can possibly form, by which an airtight seal can be obtained that prevents calcification even on the pin layers that are located upstream on the inflow side.

In order to additionally reduce the flow speed and in order to encourage a good air mixture, it can be advantageous if the deflector pins of adjacent pin layers are each arranged crosswise, and preferably at right angles to each other. Such a flow regulation device, in which the deflector pins of at least two adjacent pin layers are each arranged crosswise to each other, has practically a grid structure in an overhead view, without having to deal with the calcification customary for traditional flow regulator sieves.

A controlled and uniform flow regulation is encouraged when the distance between adjacent pins of a pin layer is approximately equal.

A simple embodiment form according to the invention provides that the deflector pins are arranged approximately radially to the longitudinal axis of the flow regulator. In this way, an especially advantageous embodiment form according to the invention provides that the deflector pins project radially from a central mounting part.

In order to be able to arrange the deflector pins next to each other in an approximately grid shaped manner in at least one plane oriented crosswise to the flow-through direction, it can be advantageous if the deflectors are connected via at least one particular support arm (22) to the mounting part (20) as a single piece. In this way, the deflector pins of at least two adjacent pin layers are arranged approximately unidirectionally or oriented crosswise to each other.

In a flow regulator housing that is comprised of at least two sleeve parts, the deflector pins are provided on a sleeve part wall section of at least one sleeve part functioning as a mounting part and can be arranged parallel to each other or even essentially radially to the flow regulator longitudinal axis.

So that undesired fluctuations of the pins can be prevented and they can be held secure and fixed in the sleeve-shaped housing, a preferred embodiment form according to the invention provides that the pins are formed through pin sections allocated to one another and that the sleeve parts forming sectors of space each have pin sections.

Even more complex deflector arrangements can be manufactured at a comparatively small expense, when the sleeve parts that can be combined into a sleeve-shaped flow regulator housing or housing section, with each carry deflector pins or pin sections of at least one pin layer, which are allocated to each other.

It is fundamentally possible to form the flow regulator housing of the flow regulator according to the invention from several sleeve parts which have approximately horizontal separable planes between them. In order, however, to easily deform the sleeve parts that are manufactured as plastic injection molded parts and in order to manufacture and assemble the flow regulator according to the invention with the smallest possible expense, a preferred embodiment according to the invention consists in that in particular two mounting parts formed as cylindrical sections, preferably separated in a longitudinal central area of the flow regulation device, are provided having pin sections that are aligned with each other in the mounting position. In this embodiment form, the two sleeves parts form three-dimensional cylinder sections that have corresponding pin sections on their sleeve wall sections, so that only through the combination of these two sleeve parts of the flow regulator is it for the most part finished.

It is also possible, however, that only one of the sleeve parts that forms a cylinder sector is constructed as a mounting part with the deflector pins molded on, and that at least one additional mounting part forms the missing cylinder sector for a surrounding flow regulator housing having the form of a sleeve.

In order to hold the flow regulator in a closed mounting position after its manufacture, it is advantageous when in a separation area of the sleeve parts that are constructed especially as mounting parts, adhesives are used for holding it in a closed mounting position.

Thereby, the simple and cost-effective manufacture of the flow regulator according to the invention is more favored when as the connection means, snap-in connections and/or fasteners are provided, on the sleeve parts that are especially equipped as mounting parts, with preferably complementary connection parts that mesh into each other. In addition, for example in another partial area of the separation plane, or instead of this, as connection means for connecting the sleeve parts in closed mounting position, an ultrasonic welding connection can also be provided.

In order to ensure the stability of the deflector pins formed from pin sections that are associated with each other, and in order to be able to connect these pin sections in a practically form-fit manner together with the individual deflector pins, it is advantageous when the pin sections have complementary end contours at their free pin ends facing each other, which mesh into each other in a form-fit manner in the mounting position.

These deflector pins formed from pin sections which are associated with each other, require however in the manufacturing and assembly of the flow regulator according to the invention, a high degree of precision. In order to simplify the mounting and to reduce the manufacturing expense, a preferred embodiment form according to the invention thus provides that the deflector pins that align with each other are set off at a distance from each other by their front ends that are facing each other.

An additional embodiment according to the invention having its own significance worthy of protection provides that adjacent sleeve parts in the area of sleeve lines that are approximately parallel to the longitudinal axis of the flow regulator are connected to each other in a manner so that they can pivot using film hinge(s). The film hinges provided between the adjacent sleeve parts make possible an especially cost-effective, practical single-piece manufacture of the flow regulator according to the invention and ensure a simple assembly having proper alignment, of this flow regulator from the individual sleeve parts. In this way, an assembly having proper support of the flow regulator can also be achieved when the flow regulator consists of more than two, preferably cylinder sector formed sleeve parts. These sleeve parts must be merely bent about the pivot axis that is provided by the film hinges, in order to locate these spatial sectors in the proper assembly position.

For a radial arrangement of the deflector-pins, they can project outwardly from a central mounting part. In another embodiment according to the invention, as opposed to this one, in which the mounting part is constructed prior to being inserted into the flow regulator housing as a band-shaped flat part having deflector pins molded on as a single piece, the deflectors projecting in a projecting pin-type manner on the inside on the flat part are brought into a radial arrangement when the band-shaped flat part is bent in an approximately circular manner.

In order to be able to secure the mounting part in the flow regulator housing in a fixed manner, it can be advantageous when the mounting part consists of spring-elastic material and can be inserted by its flat form under spring-elastic pretension into a flow regulator housing. So that the arrangement of the mounting part in the flow regulator housing is also maintained for high water pressures, it is advantageous when the mounting part can be inserted especially from the inflow front side of the flow regulator housing into the housing inside until it seats on a support stop that is constructed as an inner ring flange, for example.

In order to achieve an especially effective flow conductance and flow regulation, it can be advantageous when the deflector pins set apart from each other in the flow direction are arranged displaced from each other in gaps in the circumferential direction. It is advantageous when at least two adjacent pin layers arranged crosswise to the flow-through direction have deflector pins that are displaced sideways and when the deflector pin of a pin layer that is arranged downstream is arranged in the flow path formed by the pins of an adjacent upstream pin layer.

It is advantageous when the distance of adjacent pin layers arranged on the inflow side is smaller than the distance of adjacent pin layers arranged upstream and when the pin layer located on the outlet side has deflector pins with a distance from each other and from the deflector pins of the adjacent pin layer of preferably more than 0.8 mm.

An additional advantageous embodiment according to the invention provides deflectors that are constructed as deflector-rings that preferably are arranged in an approximately concentric manner to the flow regulator longitudinal axis and in particular, are set apart at a distance in the flow direction. While the free pin ends of the deflector pins can be displaced under the water pressure into undesired vibrations, deflector rings are not susceptible to such oscillations that possibly generate noise.

In this arrangement process, it is advantageous when the deflector rings each are connected via preferably radial support pins or deflector pins to a central mounting part.

In order to promote noise development at a standard level in the flow regulator according to the invention, it can be advantageous when the ring-shaped or pin-shaped deflectors have a rounded or similar flow-encouraging cross-sectional profile and preferably a circular rounded cross-sectional profile or an oval, tear-shaped, or similar cross-sectional profile that is oriented with its longer cross-sectional extension in the flow-through direction.

Also, for a single-piece manufacture of the flow regulator that consists of several sleeve parts, several pin layers can be expediently provided, in particular two to ten, and preferably six pin layers.

In order to additionally counteract a noise development, which could possibly occur by the support pins or deflector pins or pin sections being set into vibrations during flow-through, it can be advantageous when in the connection area of the support pins or deflector pins or pin sections, supports are provided that are formed with the mounting part, especially by support ribs or similar molded-on parts. These supports also act for high liter outputs, to counteract bending of the pins or pin sections and thus ensure the proper supporting and functional arrangement of the support or deflector pins and pin layers relative to each other.

In particular, for a flow regulator having air suction, it can be advantageous when the flow regulation device is connected before a flow dispersion device with a flow dispersion plate. Accordingly, a preferred embodiment according to the invention provides that the flow dispersion plate is preferably connected as a single piece to the housing wall of one of the sleeve parts of the flow regulator housing. The single-piece connection of the flow dispersion plate on one of the sleeve parts encourages at the same time the supporting and functional arrangement of the flow dispersion plate relative to the deflector pins or deflector rings of the flow regulation device that is connected downstream in the flow direction.

In this way, an especially effective flow regulation can be achieved when the flow dispersion plate has flow-through holes which are arranged in the flow direction in an approximately aligned manner with the pin or ring shaped deflectors.

An additional embodiment according to the invention provides that the flow-through holes in the flow dispersion plate are constructed to be conically narrowing in the flow-through direction and preferably have an intake radius or intake cone on the inflow side. By this intake radius or intake cone, an undesired stalling of the flow is counteracted. The conically narrowing embodiment of the flow-through holes in the flow dispersion plate encourages a clear, sharp water stream, that has a speed in the area of the deflectors that is reduced and can be enriched with air in an especially good way.

An effective and compact embodiment of the flow regulation device is provided when the deflector pins of the first pin layer on the inflow side are arranged approximately in the flow direction aligned with to the hole axes of the flow-through holes in the flow dispersion plate.

In order to combine the individual streams that emerge from the flow regulation device and to be able to bundle them into a closed cylindrical unified stream at the out flow-side of the flow regulator according to the invention, it is advantageous when a housing constriction for bundling the flow is provided at the flow outlet end of the flow regulator housing downstream of the flow regulation device.

The functional operation of the flow regulator according to the invention may be further improved when on the inflow side before the flow regulation device or before the flow dispersion device, an attachment sieve and/or a flow-through quantity adjuster is pre-connected.

While the deflector pins arranged in adjacent pin layers can be aligned either unidirectionally or orthogonally to each other, the essentially radially arranged deflector pins can be arranged either in pin planes set off at distances from each other or—in a manner similar to a helix—in a coil-like manner.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
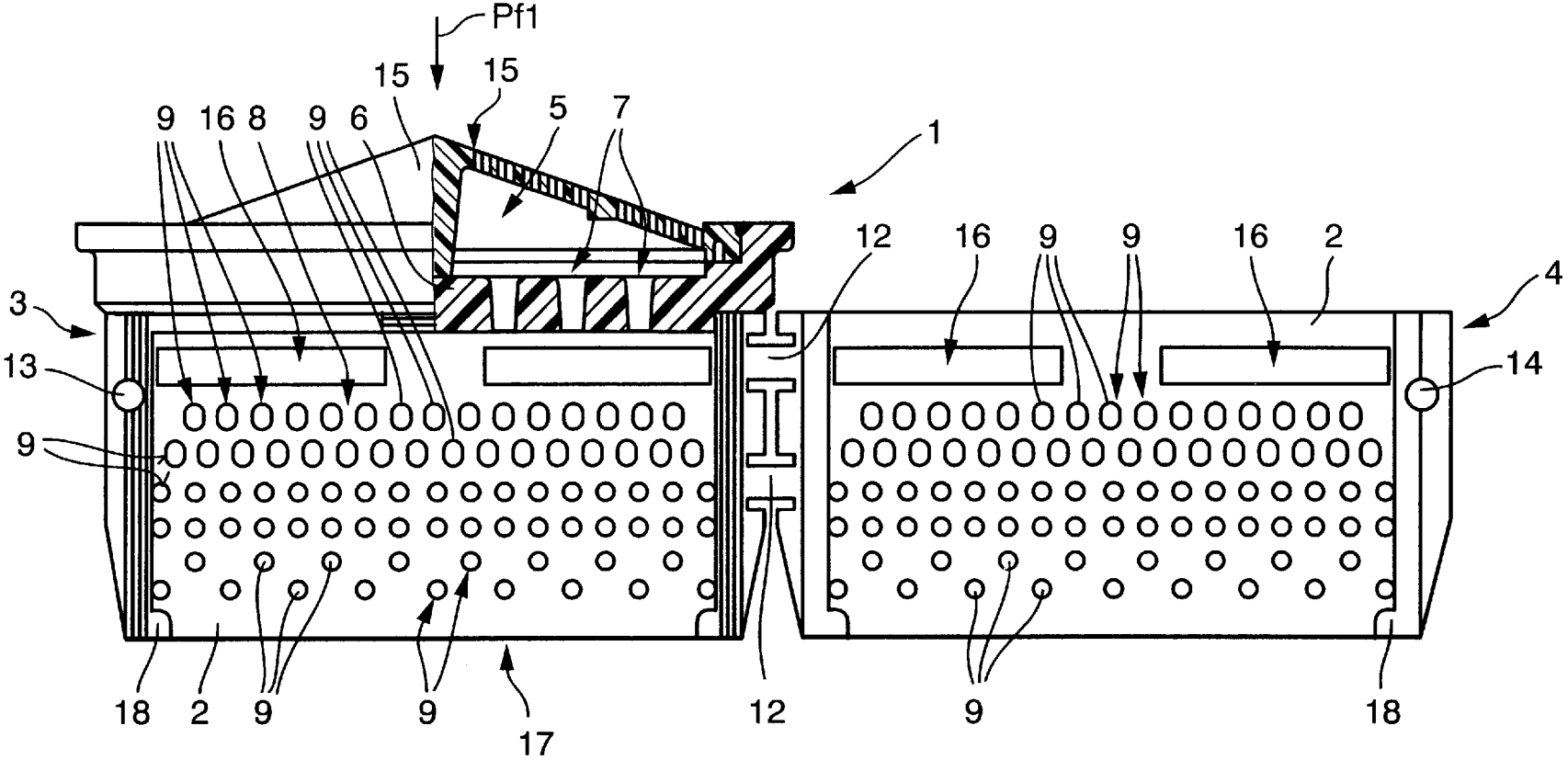
FIG. 1 is a flow regulator in a partial longitudinal section, which has a sleeve-shaped housing made of two sleeve parts that are connected to each other via a film hinge.

In FIGS. 1 to 11, different embodiments of a flow regulator 1, 103, 106, 108 and 110 are depicted, the flow regulators of which can be inserted into the outlet nozzle (not shown) of a sanitary outlet fitting and function for the generation of a water-saving, homogeneous, soft and non-spraying unified beam.

The flow regulators 1, 103, 106, 108 and 110 depicted here have a flow dispersion device 5, after which is connected a flow regulation device 8 in the flow direction Pf1. These flow regulation devices 8 have several pin-shaped or ring-shaped deflectors 9, 23, which are arranged in the flow path and crosswise to the flow direction Pf1. The deflectors 9, 23 are set off at distances from each other in the flow direction Pf1 and are connected as a single piece to at least one mounting part 3, 4, 19, 20, which is constructed with the molded-on deflectors 9, 23 as a plastic injection molded part. The mounting part 3, 4, 19, 20 of the flow regulator embodiments depicted here is constructed either so that it can be inserted into a flow regulator housing 2 or as a flow regulator housing.

The flow regulator devices 8 of the flow regulator 1, 103, 105, 106, and 108 depicted in FIGS. 1 to 9 have several pin layers set apart at a distance from each other in the flow direction Pf1, which are arranged in a plane that is oriented crosswise to the flow-through direction. The deflector pins 9 of the individual pin layers for the flow regulators 1, 103, 105 depicted in FIGS. 1 to 5 are arranged parallel to each other in a grid-like manner, while the deflector pins 9 of the flow regulators 106, 108 shown in FIGS. 6 to 9 are oriented approximately radially to the flow regulator longitudinal axis.

The flow regulators 1, 103, 105, 106, 108 and 110 shown here can be manufactured from a few separate parts at a small expense in a cost-effective manner. The flow regulation device 8 designed as a plastic injection molded part is simple to mount, without a costly insertion of customary flow regulator sieves being necessary. By the spaced apart arrangement of the plastic deflectors 9, 23 in the flow direction and in the circumferential direction, a considerably smaller calcification of the flow regulation device 8 is to be dealt with, than otherwise occurs in customary flow regulator sieves especially at the intersection points of the grid network structure of the individual sieves. With the deflectors 9, 23 oriented crosswise to the flow direction Pf1, a high flow regulation can then be achieved for high liter outputs in order to ensure the occurrence of no more than a standard noise level development.

Figure 2:
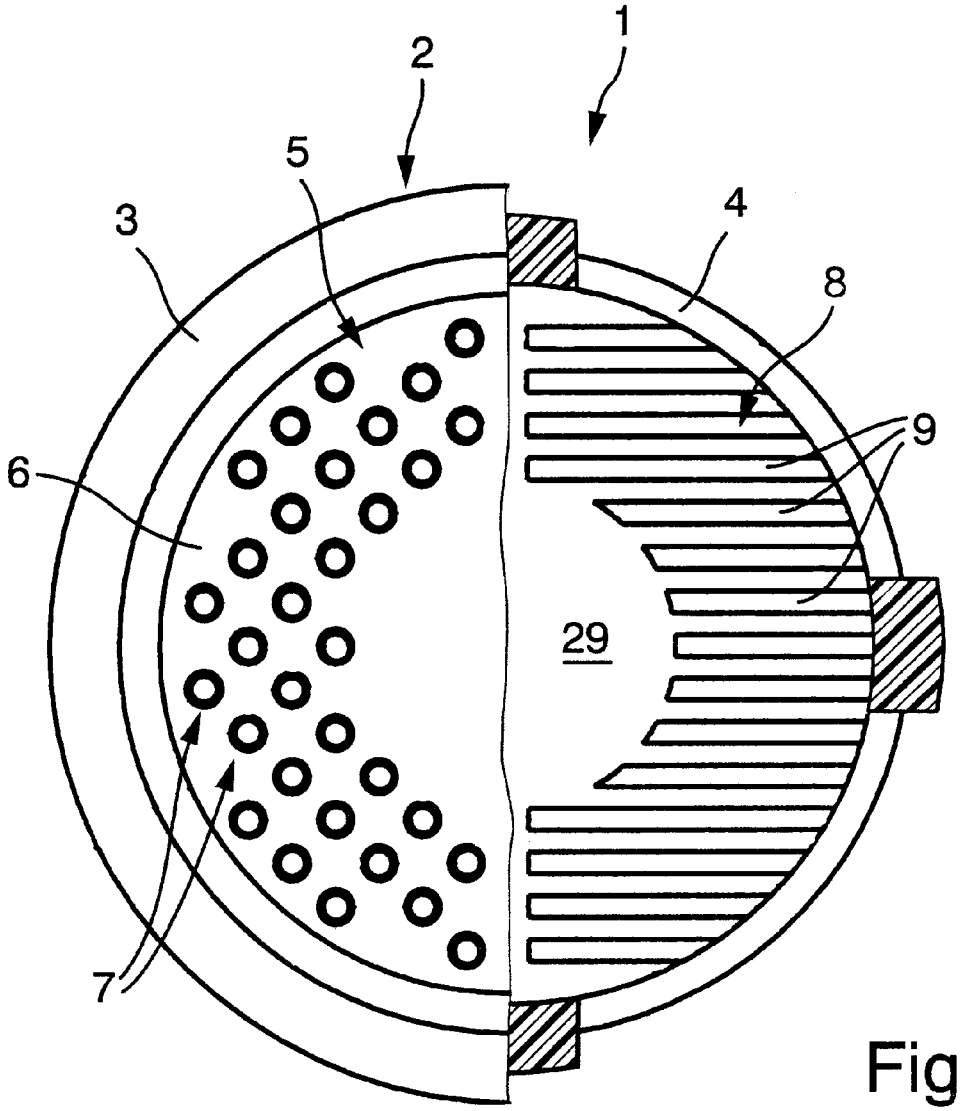
FIG. 2 is an overhead view, partially in cross-section, of the assembled flow regulator of FIG. 1.

The flow regulator 1 depicted in FIGS. 1 and 2 has a sleeve-shaped housing 2, which is comprised of two sleeve parts. The flow regulator 1 can be inserted into an outlet nozzle (not shown) which can be mounted on a sanitary outlet fitting.

The flow regulator 1 has a flow dispersion device 5 that has a flow dispersion plate 6. As is clear from the FIGS. 1 and 2, the flow dispersion plate 6 is constructed as a perforated plate that has flow-through holes 7 oriented in the flow-through direction. The flow dispersion device 5 is connected upstream of a flow regulation device 8 in the flow direction Pf1, which consists of several unidirectional deflector stays or deflector pins 9 running at approximately a right-angle to the flow direction Pf1. These deflector pins 9 are connected as a single piece with the sleeve part wall section of at least one sleeve part which functions as a mounting part 3, 4.

As shown in FIG. 1, the deflector pins 9 are provided on both sleeve parts of the flow regulator housing 2 which function as mounting parts 3, 4. In this manner, the mounting parts 3, 4 each have deflector pins 9 that are associated with each other in pairs and arranged approximately coaxially to each other. Since the free front ends of the deflector pins 9 associated with one another are set apart at distances from each other while forming a central through-passage channel 29, the simple mounting of the flow regulator 1 is even more favored. The sleeve parts of the flow regulator housing, equipped as mounting parts 3, 4, thereby form spatial cylinder sectors, so that by simple, properly aligned combination of the sleeve parts that function as mounting parts 3, 4, the flow regulator 1 can be assembled and finished to a large extent.

While in the flow regulator depicted in FIGS. 1 and 2, the free front ends of the deflector pins 9 provided on the mounting parts 3, 4 can be set at a slight distance from each other, it is also possible in an embodiment form that is not depicted in further detail here, that the deflector pins of the flow regulation device are formed by pin sections that are associated with each other in pairs and aligned with each other, so that the sleeve parts of the flow regulator housing also functioning here as mounting parts are additionally connected together into a single piece with respectively one of the pin sections of a pin section pair.

From FIG. 1 it is clear that the mounting parts 3, 4 are connected to each other as a single piece by film hinges 12. By folding together the mounting parts 3, 4 which are separated from each other in a longitudinal central area of the flow regulation device 8, on the pivot axis formed by the film hinges 12, the flow regulator 1 can be aligned in precisely the desired position. Connecting means are provided, in the separation area of the mounting parts 3, 4 opposite the pivot axis, which hold the flow regulator 1 in its closed mounting position. As a connecting means, a snap-in fastener and/or snap connection is provided which consists of complementary connection parts 13, 14 on the opposite sides of the mounting parts 3, 4 that mesh with each other on the opposite sides of the mounting parts 3, 4 in the mounting position. In like manner, the mounting parts 3, 4 could also be adhered or, for example, connected to each other through an ultrasonic welding connection.

Furthermore, it is also possible that the sleeve parts can be constructed separate from each other and can be completed by joining them and inserting them into an outlet nozzle for a flow regulator housing.

The high stability of the deflector pins 9 is further promoted when in the connection area of the deflector pins 9 supports are provided with the mounting part formed by support ribs or similar mounting part-side molded-on parts.

As is clear from a comparison of FIGS. 1 and 2, the flow dispersion plate 6 of the flow dispersion device 5 is connected as a single piece with the housing wall of the sleeve part functioning as a mounting part 3. This flow dispersion plate 6 is molded-on as a single piece to the mounting part 3 thus forms a precisely formed inflow-side seal of the flow regulator 1. For the functionally correct operation of the water-saving flow regulator 1, a flow-through sieve 15 and/or even a flow-through limiter or flow-through quantity regulator can be supported and fixed on the inflow-side of the flow regulator, pre-connected in the flow-through direction, not depicted, and can preferably be detachably attached.

The sleeve parts of the flow regulator 1 can be manufactured as plastic injection molded parts in a cost-effective manner. By the single piece connection of the sleeve parts functioning as mounting parts 3, 4, they can be assembled at a low cost. Since the flow regulator 1 consists only of one material, it can be removed in an especially easy manner or furnished for reuse of its plastic material.

In order to prevent an undesired and possibly also noise-creating flow stall, the flow-through holes 7 are constructed in the flow dispersion plate 6—as shown in FIG. 1—in the flow-through direction Pf1 to be conically narrowing and have on the inflow side, a funnel shaped intake cone. Of the deflector pins 9 arranged in six approximately parallel pin layers, those of the inflow side first pin layer are arranged approximately aligned in the flow direction to the hole axes of the flow-through holes 7 in the flow dispersion plate 6. The deflector pins 9 of the following second and third pin layers are constructed such that the deflector pins 9 of a pin layer arranged downstream lie in the flow path formed by the deflector pins 9 of an adjacent upstream pin layer. In this manner, an effective distribution of the separate streams generated in the flow dispersion plate 6 is achieved. These separate streams can thus be mixed especially well with the air drawn in via the air intake openings 16 provided in the housing wall.

The deflector pins 3 of the third, fourth, and fifth pin layer are, in contrast, arranged below each other in the flow direction Pf1 and thus encourage the bundling of the individual streams into a hardly spraying unified stream at the flow outlet end 17 of the flow regulator 1. This bundling of the separate streams into a concentric unified stream is additionally promoted by a housing constriction 18 that is rounded on the inflow side and provided at the flow outlet end 17 of the flow regulator housing 2.

As is clear from FIGS. 1 and 2, the deflector pins 9 of the pin layers are arranged at a uniform distance from each other. In FIG. 1, it is shown that the distance from the pin layers arranged on the in-flow side is smaller than the distance from the adjacent pin layers arranged downstream. The pin layer arranged on the outlet side has deflector pins 9 which have a distance of preferably more than 0.8 mm from each other and from the deflector pins 9 of the adjacent fifth pin layer. The deflector pins 9, displaced comparatively far apart from each other, of the sixth pin layer arranged downstream, are thus set apart at a distance from each other so that a function-impairing calcification is prevented and there is possibly residual water left over that forms a water layer that seals off the flow regulator 1. This water layer remains on the sixth pin layer to create an airtight seal that prevents calcification even for the pin layers located on the inflow side. The flow regulation device 8 of the flow regulator 1, with its pin layers arranged approximately at a right-angle to the flow direction, does not have a tendency to calcify anyway, since in this flow regulation device 8, flow regulator sieves that are otherwise customary, which easily calcify especially at the intersection points of their grid network structure and lead to functional damages, can be omitted.

The flow regulator 1 depicted in FIGS. 1 and 2 is characterized even for high liter outputs by a standard noise development. An undesired high noise development is further counteracted when the deflector pins 9 have a rounded or similar cross-sectional profile that encourages the flow. Accordingly, the deflector pins 9 of the first two pin layers on the inflow side have a cross-sectional profile that is oriented with their longer cross-sectional extension in the flow-through direction Pf1 and also resists high water pressures well.

Figure 3:
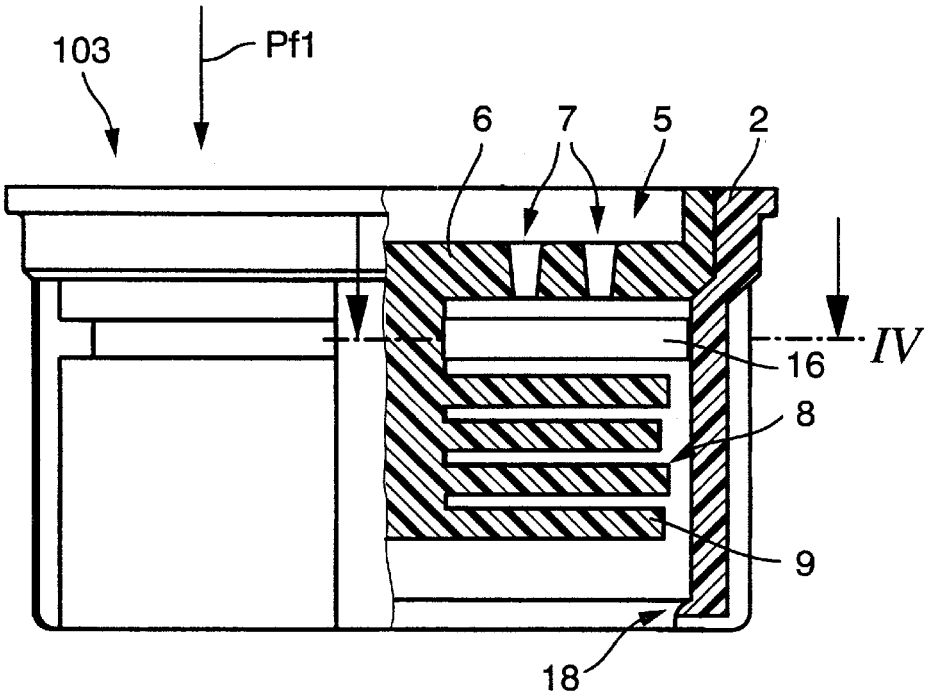
FIG. 3 is a partial longitudinal section of a flow regulator having a flow regulation device that includes several pin layers which have pin layers each arranged parallel to each other respectively.
Figure 4:
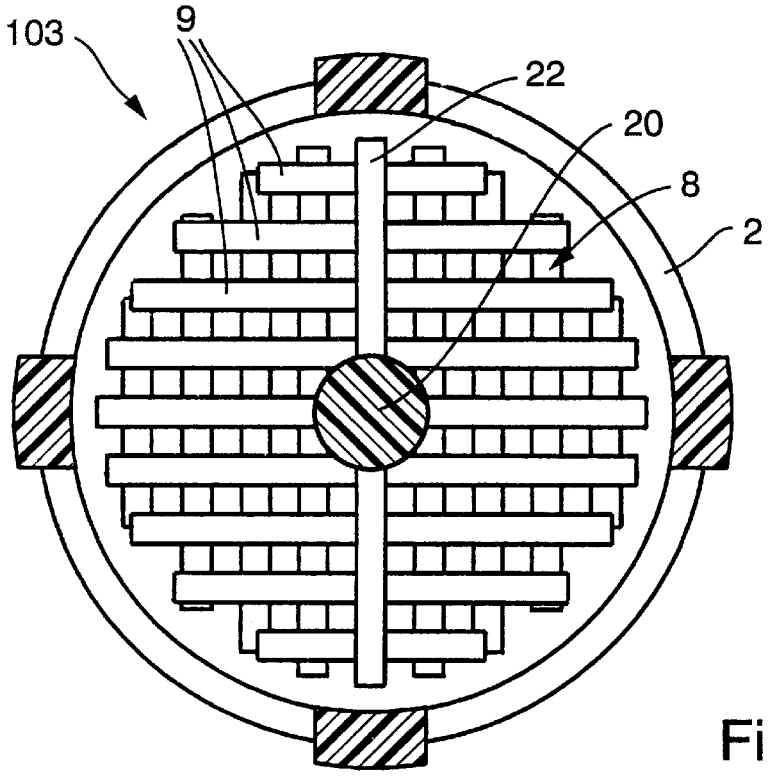
FIG. 4 is a cross-sectional view taken along line IV—IV of the flow regulator of FIG. 3.

While the deflector pins 9 of the flow regulator 1 shown in FIGS. 1 and 2 are molded onto the sleeve parts which function as mounting parts 3, 4 of the flow regulator housing, the deflector pins 9 in the flow regulator 103 shown in FIGS. 3 and 4 are connected via radial carrier arms 22 to a central mounting part 20. This mounting part 20 is held approximately in the middle on the downstream flat side of the flow dispersion plate 6 and connected as a single piece to the flow dispersion plate. Thus, the perforated plate 6 and the mounting part 20 can be inserted from the inflow side front into a separate flow regulator housing 2 to contact an inner support stop. As the FIGS. 3 and 4 show, the flow regulator 103 consists merely of two separate parts which can be manufactured especially as injection molded plastic parts at a small expense and are easily mounted to each other.

As is clear from FIG. 4, the deflector pins 9 are oriented parallel to each other in the individual pin layers in a grid shaped manner. The deflector pins 9 of adjacent pin layers are arranged approximately at right angles to each other such that the arrangement of the deflector pins 9 relative to each other apparent in FIG. 4 results. This grid network structure of the deflector pins 9 allows an effective reduction of the flow speed and promotes the good flow regulation and air blending in the flow regulator 103.

Figure 5A:
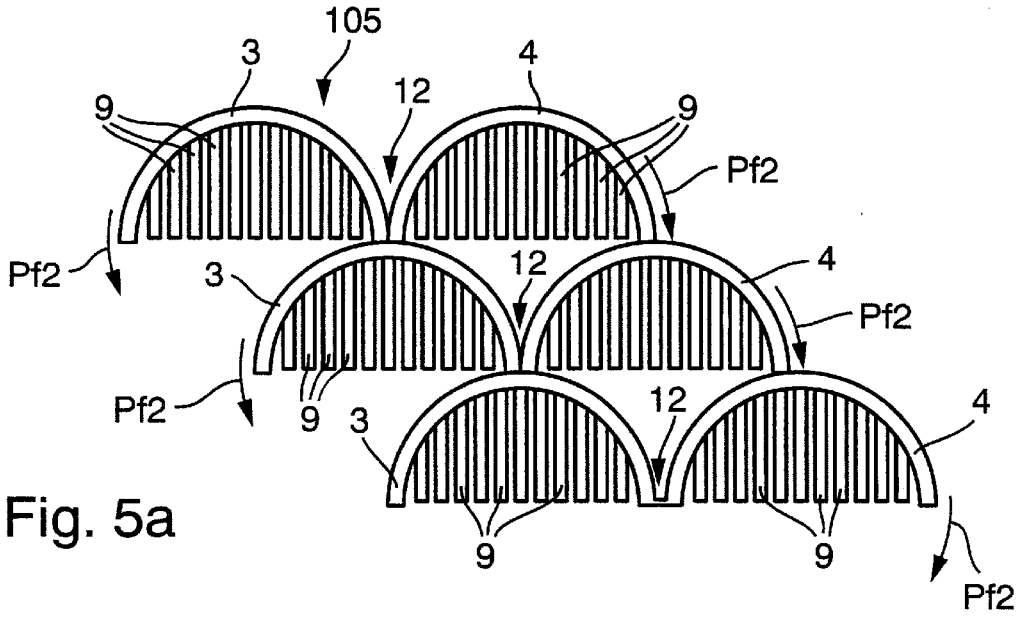
FIG. 5*a* is an overhead view of a flow regulator in an expanded assembly position of a flow regulation device constructed as an insert part from several cylinder sectors.
Figure 5B:
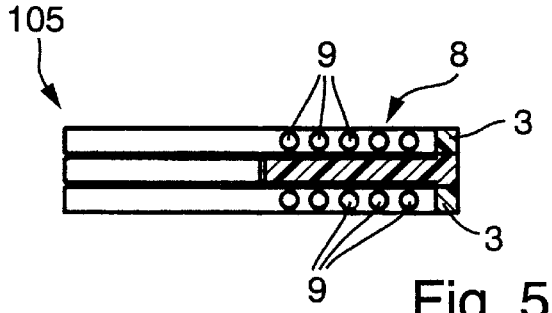
FIG. 5*b* is a partial longitudinal section of the flow regulation device of FIG. 5*a* in the functional position.
Figure 5C:
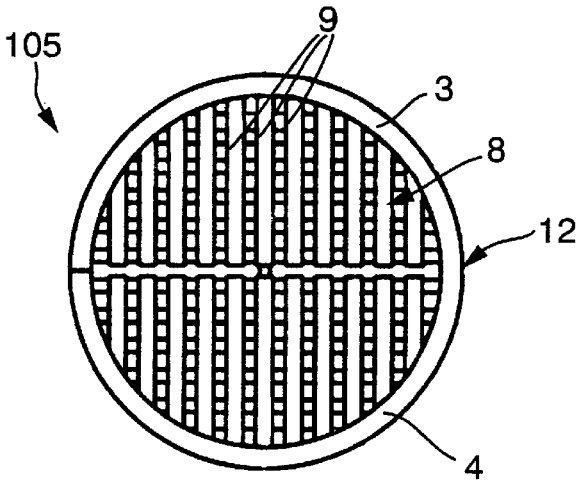
FIG. 5*c* is an overhead view of the flow regulation device of FIG. 5*b* in the functional position.

As FIG. 5 shows, an otherwise not further depicted flow regulator 105 can also be subdivided by separation planes provided crosswise to the flow-through direction and between the individual pin layers. Each sleeve section of the flow regulation device 8 that receives a pin layer has two sleeve parts that form cylinder sectors that each function as mounting parts 3, 4 for the deflector pins molded-onto them. The sleeve parts that are associated with each other are displaced in the circumferential direction with one of the sleeve parts of an adjacent housing section, so that the flow regulation device 8 according to FIG. 5 can also be manufactured as a single piece. By simple snap-fastening in the direction of arrows Pf2 as well as joining of the mounting parts 3, 4 allocated to each other and connected to each other via a film hinge 12, the flow regulation device 8 can be brought into its functional position, in which the deflector pins 9 form the grid structure apparent in FIG. 5*b* and FIG. 5*c*. As is clear from FIG. 5*c*, the deflector pins 9, allocated to each other and molded onto the mounting parts 3, 4, are coaxially arranged to each pin layer such that the free pin ends of these pin pairs are slightly set off at distances from each other.

The mounting parts 3, 4 provided in pairs to each other are connected respectively in the flow direction to the adjacent mounting part pair 3, 4 in the area of a hinged joint 12. After the fastening and joining of these mounting parts 3, 4 connected as a single piece to each other, the essentially sleeve shaped flow regulation device 8 forms a housing section of the flow regulator housing by its outer wall section.

Figure 6:
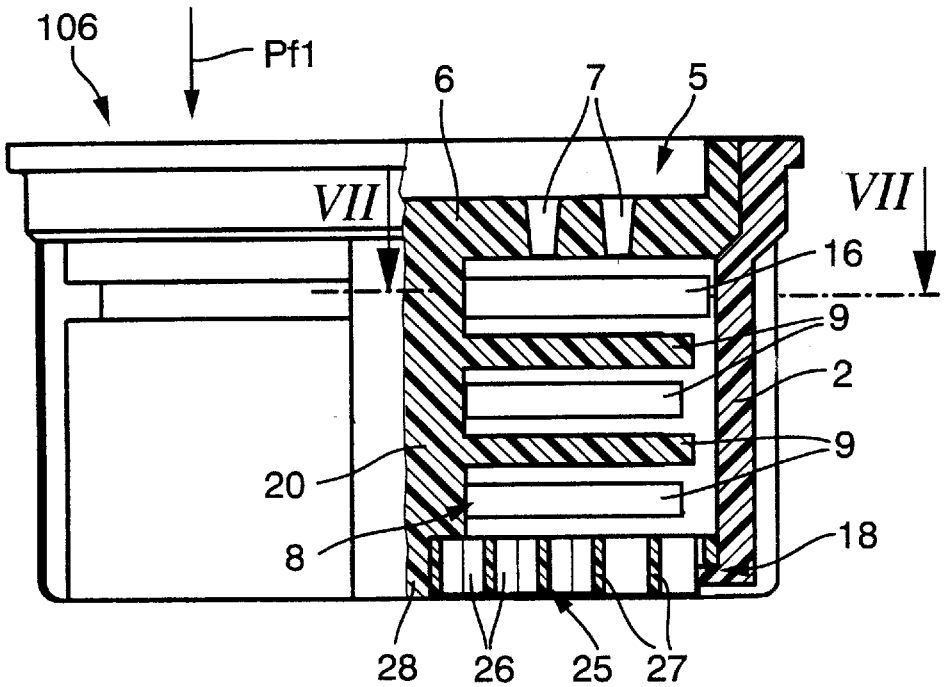
FIG. 6 is a partial longitudinal sectional view of a flow regulator in that it has a flow regulation device having several deflector pins arranged set off at gaps from each other, where the deflector pins project radially from a central mounting part.
Figure 7:
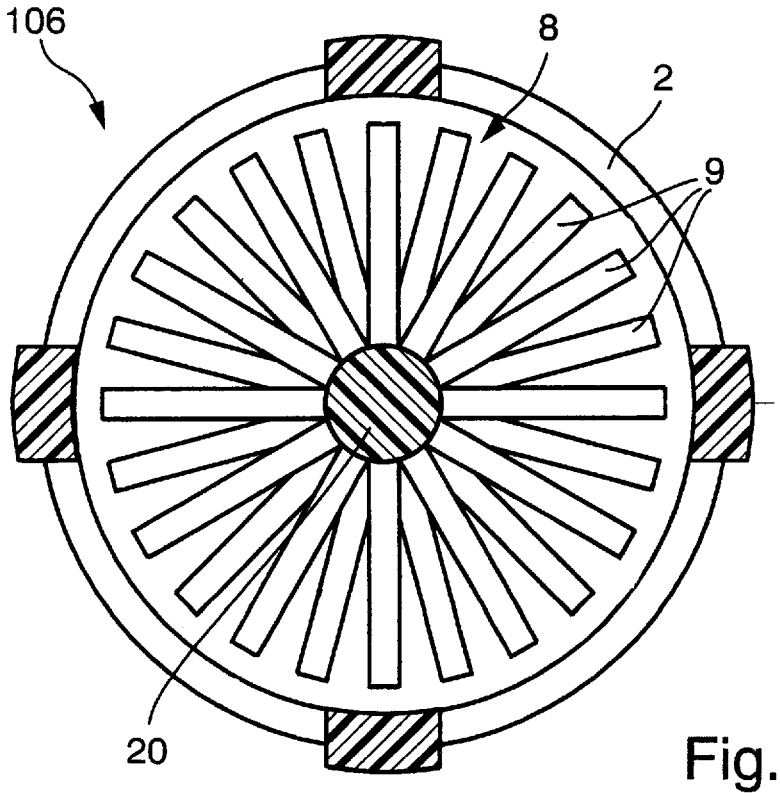
FIG. 7 is a cross sectional view taken along lines VII—VII of the flow regulator from FIG. 6.

In the FIGS. 6 and 7, a flow regulator 106 is depicted which has a flow regulation device 8 that has radially arranged deflector pins 9. These deflector pins 9 are connected as a single piece to a central mounting part 20 that is molded onto the perforated plate 6 on the downstream side of the flow dispersion device 5. The deflector pins 9 project radially outwardly from the mounting part 20 and are set off at a slight distance by their free front ends from the inside wall of the flow regulator housing. The rod-shaped mounting part 20 is—just as in FIGS. 3 and 4—arranged approximately coaxially to the flow regulator longitudinal axis and can be inserted with the molded-on flow dispersion plate 6 from the front, incoming flow side into the flow regulator housing 2 until reaching a support stop.

In the FIGS. 6 and 7, several of the radial deflector pins 9 are arranged at a time in several pin layers that are set off at a distance from each other in the flow direction Pf1. Instead of acting in these types of pin planes, at least one part of the deflector pins 9 can interact in an approximate coil shape with another one on the mounting part 20. Thus, it is advantageous when the deflector pins 9—as depicted—are arranged displaced in gaps to one another.

Figure 8:
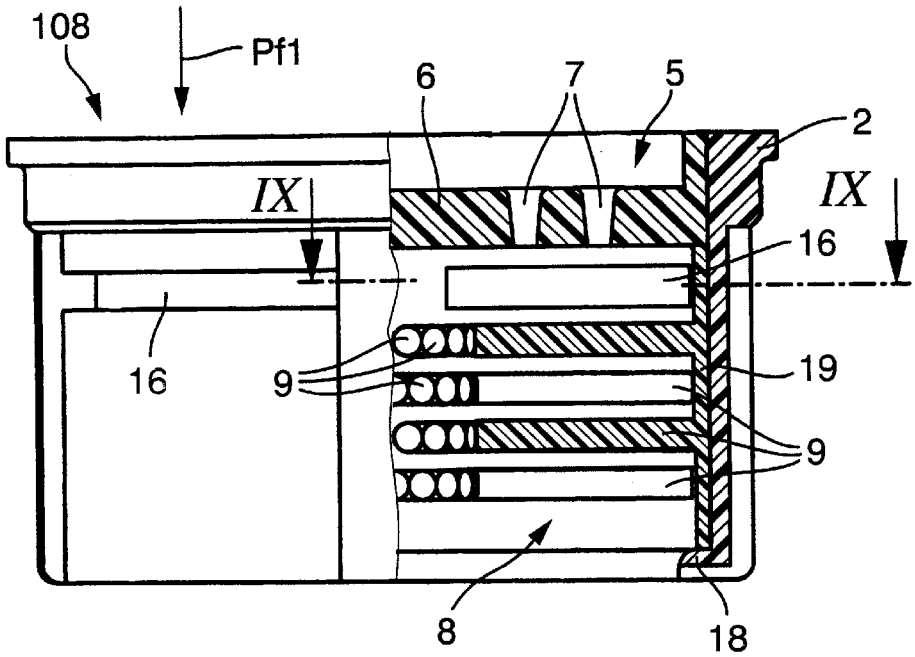
FIG. 8 is a partial longitudinal section of a flow regulator in which the deflector pins project radially inwardly from a mounting part constructed as a flexible flat piece.
Figure 9:
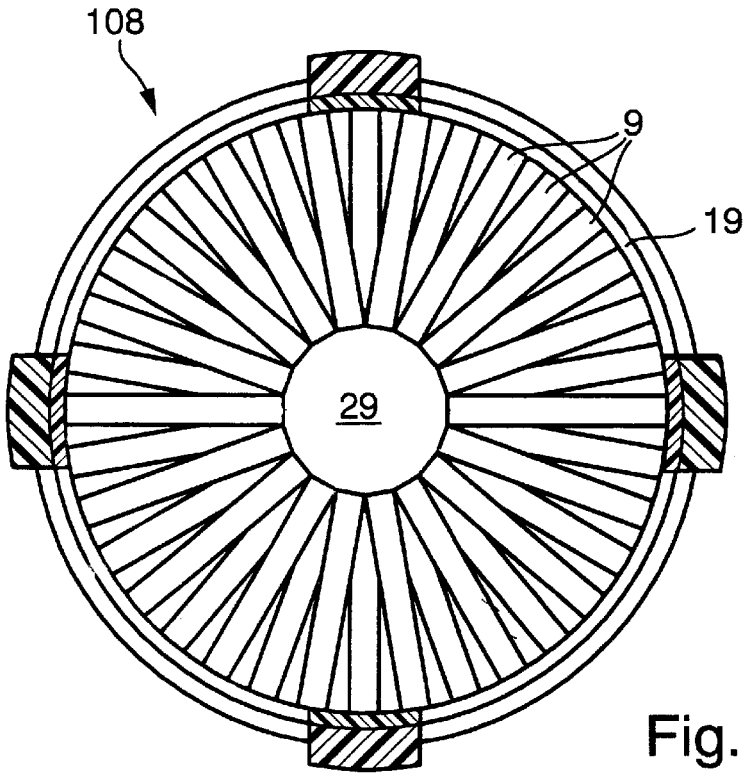
FIG. 9 is a cross-sectional view taken along line IX—IX of the flow regulator from FIG. 8.

In FIGS. 8 and 9, a flow regulator 108 is depicted, in which the mounting part 19 is constructed as a flat, band-shaped piece. On the flat, band-shaped piece 19, the pin shaped deflectors 9 are molded-on as a single piece on the inside and are spaced apart and perpendicular to the flat part plane. By circular-shaped bending over of the flat band-shaped part 19, the deflector pins 9 can be brought into their functional position depicted in FIGS. 8 and 9, and the mounting part 19 with the molded-on deflector pins 9 can be inserted up to a flange-type support stop on the downstream side from the incoming flow side into the flow regulator housing 2. So that the mounting part 19 can be held secure in the flow regulator housing 2 and rests in a planar manner on the housing inner side, it is advantageous when the mounting part 19 consists of spring-elastic material and can be inserted by its flat shape under elastic pretension into the flow regulator housing 2.

Also, the deflector pins 9 molded onto the band-shaped flat part 19 can be arranged in groups in several pin layers. It is also possible, however, that the deflector pins 9 are arranged in a coil shape relative to each other in the functional position.

As is clear from the FIGS. 8 and 9, the deflector pins 9 projecting radially inwardly on the flat mounting part 19 define a central flow-through channel 29 by their free ends.

The flow regulators 1, 103, 105, 106, and 108 depicted in the FIGS. 1 to 9, have pin-shaped deflector pins 9. In addition, or instead of this, at least one part of the necessary deflector can also be constructed in a ring shape. Thus, a flow regulator 110 is depicted in the FIGS. 10 and 11, that has a flow regulator device 8 that has several deflector rings 23 that are set apart from each other at distances. These deflector rings 23 are connected as a single piece via radial support arms 22 to a central mounting part 20.

Figure 10:
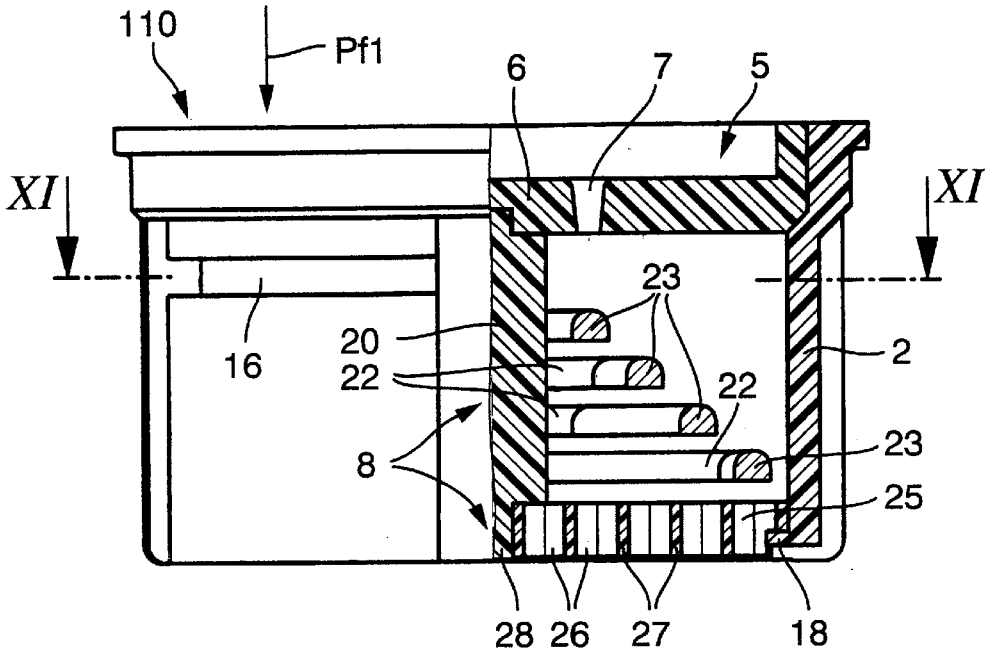
FIG. 10 is a partial longitudinal section of a flow regulator having a flow regulator device that has concentric deflector rings arranged at distances from each other.
Figure 11:
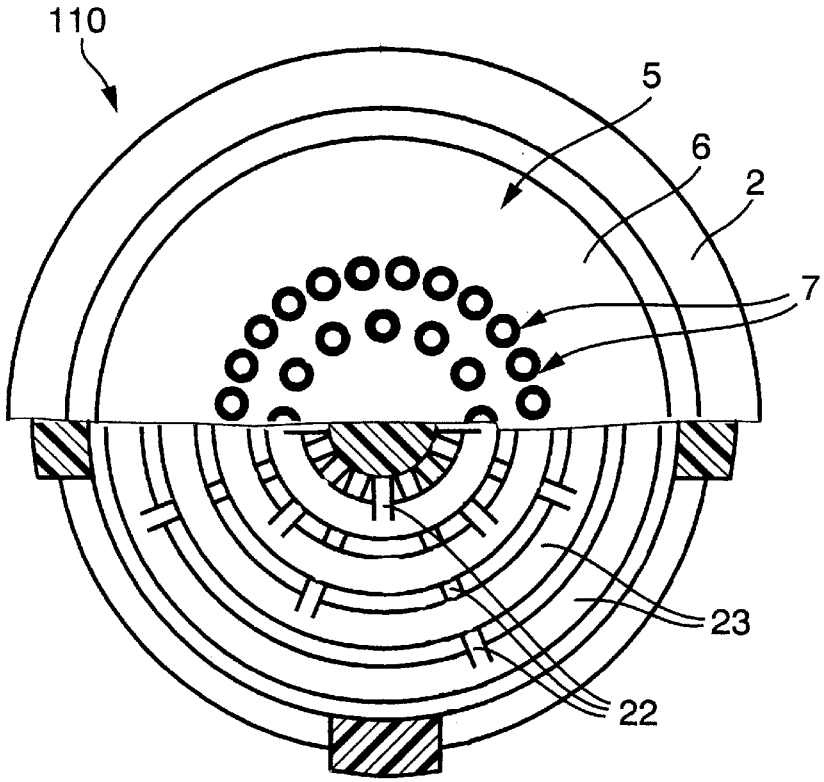
FIG. 11 is a partial overhead view of the flow regulator from FIG. 10.

As shown in FIG. 10, the inflow side flow-through holes 7 of the flow distribution device 5 pre-connected in the flow direction are arranged essentially in concentric circles in the flow direction to approximately align with the ring-shaped deflectors 23. Also, the support arms 22 can function as deflectors, if they lie approximately in the alignment direction of the flow-through holes 7 arranged in the flow distribution plate 6.

As FIGS. 6 and 10 show, the flow regulation device 8 of the flow regulators 106 and 110 also has on the outlet side a perforated plate 25 that has several flow-through holes 26 at least in one partial area constructed as a perforated field, of its planar surface that is oriented transversely to the flow direction. The adjacent flow-through holes 26, which have guide walls 27 that are separated from each other and extend approximately in the flow direction Pf1, each have a wall thickness that amounts to a fraction of the internal hole diameter of a flow-through hole 26 defined by the guide walls 27. The perforated plate 25 is comparatively small and measured so that the ratio between the height of the guide walls and the total diameter of the flow regulation device 8 is less than 1. A ratio between the height of the guide walls and the overall diameter of the flow regulator device is preferred which is smaller than 3:21.

In the perforated plate 25 of the flow regulation device 8, the separate streams coming from the flow dispersion device 5 can be combined into a homogeneous soft unified stream. Whereas traditional flow regulation sieves can at most conduct the incoming separate flow streams via the thickness of their wire diameter, the flow-through holes 26 in the flow regulation device 8 of the flow regulators 106, 110 have a comparably larger longitudinal extension with their guide walls 27 so that in them the separate water streams are better able to be shaped because of the longer acting adhesion forces. At the same time, however, the guide walls 27 provided in the perforated plate of the flow regulation device are not constructed higher in comparison to the overall diameter of the flow regulation device, so that the formation of a soft bubbling total stream is fostered. Since the flow-through holes 26 are at the same time only separated from each other by the thin guide walls 27, and correspondingly lie close together, the separate streams unite after passing through the flow regulation device 8 into a bubbling-soft, unified total stream that only sprays a little. The perforated plate 25 of this flow regulation device 8 can also be manufactured as an injection molded part or extruded part made of plastic or any other suitable material in a cost-effective manner. By its homogeneous construction, the perforated plate 25 of the flow regulator 106, 110 depicted in FIGS. 6 and 10 has less of a tendency to become calcified or contaminated due to the material contents carried in the water, so that the functional reliability of the flow regulator 106, 110 is considerably favored.

In order to be able to optimally form the water flow on as large a wall surface as possible of the guide walls 27 provided in the perforated plate 25, it is preferred if the perforated plate 25 has as many flow-through openings 26 as possible. For this, the flow-through holes 26 of the perforated plate 25 can have a round, rounded, circular segment-type or angular, in particular, a hexagonal flow-through cross section. In FIGS. 6 and 10, the flow-through holes 26 of the hole plates 25 form an essentially honeycomb cell-like perforated field, that is able to shape the water stream especially well without simultaneously opposing it with a disruptive flow resistance.

To prevent the transfer of undesired vibrations to the deflectors 9, 23, it can be advantageous when the end of the central mounting part 20 that faces away from the flow dispersion device 5 is centered in the flow regulator housing. For this, the central mounting part 20 of the flow regulator 106, 110 depicted in the FIGS. 6 and 10 has on its end that faces away from the flow dispersion device 5, a projecting centering pin 28, which is inserted in an approximately central centering opening of the perforated plate 25, which is provided on the flow regulator housing, of the flow regulator device 8.

In FIGS. 6 and 10, the perforated plates 25 of the flow regulation device 8 are inserted from the inflow side out into the housing inside of the flow regulator housing 2. It is also possible, however, to form the perforated plate 25 of the flow regulator device 8 as a single piece on the flow regulator housing 2, such that an even better protection of the inflow side insert parts of the flow regulator is ensured against unauthorized manipulations or movement.

In order to join the separate streams in an especially good manner and to be able to bundle them in the flow regulation device 8 into a closed cylindrical unified stream, the flow regulators 106 and 110 have, on the flow outlet end of their flow regulator housing 2, behind the flow regulator device 8, a housing constriction 18 for bundling the stream.

It will be appreciated by those skilled in the art that changes can be made to the embodiments described above without departing from the broad inventive concept. It is understood, therefore, that this invention is not limited to the particular embodiments disclosed, but it is intended to cover modifications within the spirit and scope of the present invention.

What is claimed is:

1. Flow regulator (1, 103, 105, 106, 108, 110) with a sleeve-shaped housing (2) in which a flow regulation device (8) is arranged that has deflectors (9, 23) oriented crosswise to the flow direction (Pf1), the sleeve-shaped housing (2) being divided in a longitudinal direction of the flow regulator (1, 105) and comprising at least two sleeve parts (3, 4) configured as circumferential segments which are constructed as plastic injection molded parts, the deflectors (9) being constructed as deflector-pins (9) and having free pin ends, which project from at least one of the circumferential segments, and being connected with the circumferential segment.

2. Flow regulator (108) according to claim 1, further comprising a mounting part (19) that is constructed as a flat, band-shaped part prior to being inserted into the flow regulator housing (2), the deflectors (9) constructed as the deflector-pins project radially and are molded as a single piece with the flat, band-shaped part.

3. Flow regulator (103, 106, 110) according to claim 1, further comprising a central mounting part (20) arranged approximately coaxially to the longitudinal axis of the flow regulator and the mounting part (20) is connected to the deflectors (9, 23).

4. Flow regulator according to claim 1, wherein the deflector pins (9) are arranged parallel to each other in a grid shape in at least one plane oriented crosswise to the flow-through direction (Pf1) and a plurality of pin layers are arranged above each other in planes spaced apart from one another in the flow-through direction (Pf1).

5. Flow regulator according to claim 4, wherein the deflector pins (9) of adjacent pin layers are arranged crosswise to each other.

6. Flow regulator according to claim 4, wherein the separation distance of adjacent deflector pins (9) of a pin layer is at least approximately equal.

7. Flow regulator according to claim 1, wherein the deflector pins are arranged approximately radially to the flow regulator longitudinal axis.

8. Flow regulator according to claim 3, wherein the deflector pins (9) project radially from the central mounting part (20).

9. Flow regulator according to claim 8, wherein the deflectors (9) are connected via at least one special support arm (22) to the mounting part (20) as a single piece.

10. Flow regulator according to claim 1, wherein the deflector pins (9) are formed by pin sections associated with one another and that the sleeve parts forming the circumferential segments each have pin sections.

11. Flow regulator according to claim 1, wherein the sleeve parts can be combined into a sleeve-shaped flow regulator housing (2) or housing section each carry deflector pins (9) or pin sections of at least one pin layer, which are associated to each other.

12. Flow regulator according to claim 10, wherein two sleeve parts form the circumferential segments and are separated in a longitudinal central area of the flow regulation device (8), the two sleeve parts include pin sections that are aligned with each other in the assembled position.

13. Flow regulator according to claim 1, wherein in a separation area of the sleeve parts (3, 4), connection means are provided for holding the sleeve parts in a closed assembled position.

14. Flow regulator according to claim 13, wherein the connection means comprises at least one of snap-in connections and fasteners provided on the sleeve parts.

15. Flow regulator according to claim 13, characterized wherein an ultrasonic welding connection is provided as the connection means for connecting the sleeve parts equipped as mounting parts (3, 4) in the closed assembled position.

16. Flow regulator according to claim 12, wherein the pin sections have complementary end contours at the free ends which face each other and which mesh into each other in a form-fit manner in the assembled position.

17. Flow regulator according to claim 12, wherein the deflector pins (9) that align with each other are spaced apart a distance from each other at the free ends that face each other.

18. Flow regulator according to claim 1, wherein adjacent sleeve parts in an area that is approximately parallel to the longitudinal axis of the flow regulator (1) are pivotably connected to each other using a film hinge (12) or a hinged joint.

19. Flow regulator according to claim 2, wherein the mounting part (19) comprises an elastic material and can be flexed from a flat form under elastic pretension for insertion into the flow regulator housing (2).

20. Flow regulator according to claim 1, wherein the deflector pins (9) set apart from each other in the flow direction (Pf1) and are arranged offset from each other in gaps in a circumferential direction.

21. Flow regulator according to claim 1, wherein at least two adjacent pin layers have the deflector pins (9) arranged crosswise to the flow-through direction (Pfi) and shaped and that the deflector pins (9) of the pin layer that is arranged downstream is arranged in the flow path formed by the deflector pins (9) of an adjacent upstream pin layer.

22. Flow regulator according to claim 21, wherein a separation distance of the adjacent pin layers arranged on the inflow side is smaller than a separation distance of the adjacent pin layers arranged upstream and that the pin layer located on an outlet side includes the deflector pins (9) which have a separation distance from each other and from the deflector pins of the adjacent pin layer of preferably more than 0.8 mm.

23. Flow regulator according to claim 3, wherein the deflectors are constructed as deflector-rings (23) that preferably are arranged in an approximately concentric manner to the flow regulator longitudinal axis and in particular, are set apart at a distance in the flow direction (Pf1).

24. Flow regulator according to claim 23, wherein the deflector rings (23) are each connected preferably via radial support arms (22) or the deflector pins to the central mounting part (20).

25. Flow regulator according to claim 1, wherein the deflectors (9, 23) have a rounded or similar flow-encouraging cross-sectional profile selected from one of a and preferably a round-circular cross-sectional profile, or an oval, tear-shaped or oblong cross-sectional that is oriented with a longer cross-sectional extension in the flow-through direction (Pf1).

26. Flow regulator according to claim 1, wherein several pin layers are provided.

27. Flow regulator according to claim 1, wherein in the connection area of the support arms and/or deflector pins (9, 22) to the mounting part, supports are provided that are formed by support ribs.

28. Flow regulator according to claim 1, wherein the flow regulation device (8) includes a pre-connected flow dispersion device (5) with a flow dispersion plate (6).

29. Flow regulator according to claim 28, wherein the flow dispersion plate (6) is connected as a single piece to the housing wall of one of the sleeve parts of the flow regulator housing (2).

30. Flow regulator according to claim 28, wherein the flow dispersion plate (6) has flow-through holes (7) which are arranged in the flow direction (Pf1) in an approximately aligned manner with the deflectors.

31. Flow regulator according to claim 30, wherein the flow-through holes (7) in the flow dispersion plate (6) are constructed to be conically narrowing in the flow-through direction and have an intake radius or intake cone on the inflow side.

32. Flow regulator according to claim 30, wherein the deflector pins (9) of a first pin layer on the inflow side are arranged approximately aligned in the flow direction to the hole axes of the flow-through holes (7) in the flow dispersion plate (6).

33. Flow regulator according to claim 1, wherein on the flow outlet end (17) of the housing (2), downstream from the flow regulator device (8), a housing constriction (18) is provided for bundling the stream.

34. Flow regulator according to claim 1, wherein on the inflow side before the flow regulation device (8) or before the flow dispersion device (5), an attachment sieve and/or a flow-through quantity adjuster is pre-connected.

* * * * *